United States Patent [19]

Krulik

[11] Patent Number: 4,805,553

[45] Date of Patent: Feb. 21, 1989

[54] APPARATUS FOR BAILOUT ELIMINATION AND FOR ENHANCING PLATING BATH STABILITY IN ELECTROSYNTHESIS/ELECTRODIALYSIS ELECTROLESS COPPER PURIFICATION PROCESS

[75] Inventor: Gerald A. Krulik, Laguna Hills, Calif.

[73] Assignee: Morton Thiokol, Inc., Chicago, Ill.

[21] Appl. No.: 232,356

[22] Filed: Aug. 15, 1988

Related U.S. Application Data

[60] Continuation of Ser. No. 69,349, Jul. 2, 1987, which is a division of Ser. No. 923,233, Oct. 27, 1986, Pat. No. 4,719,128.

[51] Int. Cl.[4] ..... B05C 11/00

[52] U.S. Cl. ..... 118/603; 118/429; 118/690; 427/345; 204/301; 204/DIG. 13; 261/156

[58] Field of Search ..... 118/602, 603, 610, 429, 118/689, 690, 25; 427/345, 443.1; 261/156; 210/424; 204/301, 182.3, 182.4, 182.5, 182.6, 130, 147, 151, DIG. 13

*Primary Examiner*—Shrive Beck
*Assistant Examiner*—Alain Bashore
*Attorney, Agent, or Firm*—Gerald K. White

[57] ABSTRACT

A forced air, ambient temperature, evaporator coupled to an electroless copper plating bath and to a purification system for replenishing and maintaining the stability of the plating bath, which bath tends to become depleted as the result of the reduction of water soluble cupric salt in an alkaline solution under copper plating and reducing conditions and in which the rate of evaporation of water from the surface thereof is insufficient to preclude growth in the volume thereof resulting from liquid additions thereto required to replace consumed constituents, thus giving rise to a need for bailout to prevent overflow thereof, solves the following problems: evaporation is independent of plating bath geometry; very high evaporation rates enable bailout to be zero at all plating loadings and plating thicknesses; the high evaporation rates provide sufficient cooling whereby the electroless copper solution can be introduced directly to the purification system with no additional cooling; dragout losses may be completely eliminated; and the large amount of air blown through the electroless copper solution of the plating bath enhances stability by lowering the bath temperature, saturating the bath with stabilizing oxygen, and purging the bath of destabilizing waste hydrogen waste product.

1 Claim, 3 Drawing Sheets

APPARATUS FOR BAILOUT ELIMINATION AND FOR ENHANCING PLATING BATH STABILITY IN ELECTROSYNTHESIS/ELECTRODIALYSIS ELECTROLESS COPPER PURIFICATION PROCESS

This is a continuation of Ser. No. 069,349 filed on July 2, 1967 which is a division of application Ser. No. 923,233 filed Oct. 27, 1986 now U.S. Pat. No. 4,719,128.

BACKGROUND OF THE INVENTION

1. Field of the Invention

This invention relates to the chemical maintenance of electroless copper plating solutions, and more particularly, to a method of and apparatus for eliminating bailout and thus the need for waste treatment in electroless copper purification by electrosynthesis/electrodialysis, and also for maintaining the stability of the electroless copper plating solution.

2. Description of the Prior Art

In the operation of an electroless copper plating bath, a number of bath constituents are consumed. These include copper (usually in the form of copper sulfate), sodium hydroxide, and formaldehyde. Replenishment of these constituents has been effected by adding at least two, and in some cases, three or more liquid concentrates to the bath. The addition of liquid concentrates causes the volume of the bath to grow giving rise to the need for bailout which must be treated and disposed of as hazardous waste. Such disposal not only is costly but gives rise, also, to environmental concerns.

It is known in the prior art, as disclosed in U. S. Pat. No. 4,289,597 issued on Sept. 15, 1981 to David W. Grenda and in U. S. application Ser. No. 691,095 filed by Emmanuel Korngold on Jan. 14, 1985, now U.S. Pat. No. 4,600,493, issued Jul. 15, 1986, to utilize electrosynthesis/electrodialysis as a process by which formate and sulfate by-products produced as the result of the copper plating process are chemically removed from the plating bath and replaced with hydroxyl ions. This chemical action together with evaporation from the plating bath surface area, in addition to air sparging, is sufficient to eliminate the need for bailout over a range of plating production rates. Water evaporates from the plating bath due to its elevated, typically 120° F., operating temperature. If the tank surface area is sufficiently great and replenishment rates (stabilizer, copper and formaldehyde) are within a certain range, no bail-out is necessary for an experimentally determined number of square feet of boards being plated. If more square feet of boards are plated than this experimentally determined number, or if a greater thickness of copper is plated, then bailout becomes necessary. There also is a problem with plating bath volume growth due to flushing of the connecting lines to the electrosynthesis/electrodialysis apparatus during cleaning. Little additional water volume can be added to the plating bath due to the inability to vary the evaporation rate from the plating bath surface.

Thus, there is a need and a demand for an improved method of an apparatus for eliminating the need for bailout with the electrosynthesis/electrodialysis electroless copper purification process at all plating loadings and plating thicknesses within the capacity of the process. The present invention was devised to fill the technological gap that has existed in the prior art in this respect.

SUMMARY OF THE INVENTION

An object of the invention is to provide, in a system for the replenishment and maintenance of stability of an electroless copper plating solution in a plating bath, a method of and apparatus for eliminating the need for bailout at all plating loadings and plating thicknesses within the capacity of the process.

Another object of the invention is to provide, in such a system, a method of and apparatus whereby electroless copper plating solution which, during plating operation is normally at a temperature substantially higher than the ambient, may be introduced directly to an electrosynthesis/electrodialysis purification process.

A further object of the invention is to provide, in such a system, a method of and apparatus for stabilizing the electroless copper plating solution by substantially lowering the temperature thereof, saturating the solution with oxygen, and purging the solution of waste hydrogen therein.

Still another object of the invention is to provide, in such a system, a method of and apparatus for eliminating loss due to material adhering to and rinsed from boards plated in the bath, such loss being known in the art as "dragout loss."

In accomplishing these and other objectives of the invention, a forced air, ambient temperature atmospheric evaporator is coupled to an electrosynthesis-/electrodialysis electroless copper purification process system for evaporating water from the electroless copper plating bath solution. The evaporation rate or water loss, in one embodiment of the invention, is selected to lower the electroless copper bath temperature from 120° F. to a temperature in the range of 90°-95° F. at a flow rate of about 8 gallons per minute (GPM).

The large amount of air introduced into the electroless copper solution by the evaporator together with the concomitant cooling thereof results in very good stability of the electroless copper solution. This is because of saturation of the electroless copper solution with oxygen, a known electroless copper solution stabilizer. At the same time, the electroless copper solution is purged of waste hydrogen, which is known to destabilize electroless copper solution baths. The resultant highly stabilized copper plating solution can be introduced directly to the electrosynthesis/electrodialysis purification system or to an overflow sump associated with the electroless copper plating tank.

In accordance with the invention the evaporation rate of the electroless copper plating bath solution is so high relatively to the replenishment rate thereof that a deionized water line is utilized to maintain the volume of the electroless copper plating solution bath. As a result, the transfer lines to the electrosynthesis/electrodialysis apparatus can be efficiently purged with deionized water. There is no overflow of the plating tank during such purging because of the high evaporation rate. Substantially no waste chelator is flushed to the drain.

Another advantage of the arrangement is the complete elimination of dragout loss. Utilizing counter-current rinsing, a known technique, the effectiveness of a given amount of rinse water may be multiplied up to several hundred times. Thus, an efficient rinse system for an electroless copper plating system, according to the invention, may require in the aforementioned embodiment, as little as 12-30 liters of deionized water per hour. This can also be directed back to the evaporator and recycled back to the electroless copper plating solution bath, thereby enabling the recovery of most chelators and copper and eliminating the need for waste treatment.

The various features of novelty which characterize the present invention are pointed out with particularity in the claims annexed to and forming a part of this specification. For a better understanding of the invention, its operating advantages, and specific objects attained by its use, reference is made to the accompanying drawings and descriptive matter in which preferred embodiments of the invention are illustrated.

BRIEF DESCRIPTION OF THE DRAWINGS

Having summarized the invention, a detailed description follows with reference being made to the accompanying drawings which form part of the specification, of which.

DESCRIPTION OF THE PREFERRED EMBODIMENT

Figure 1:
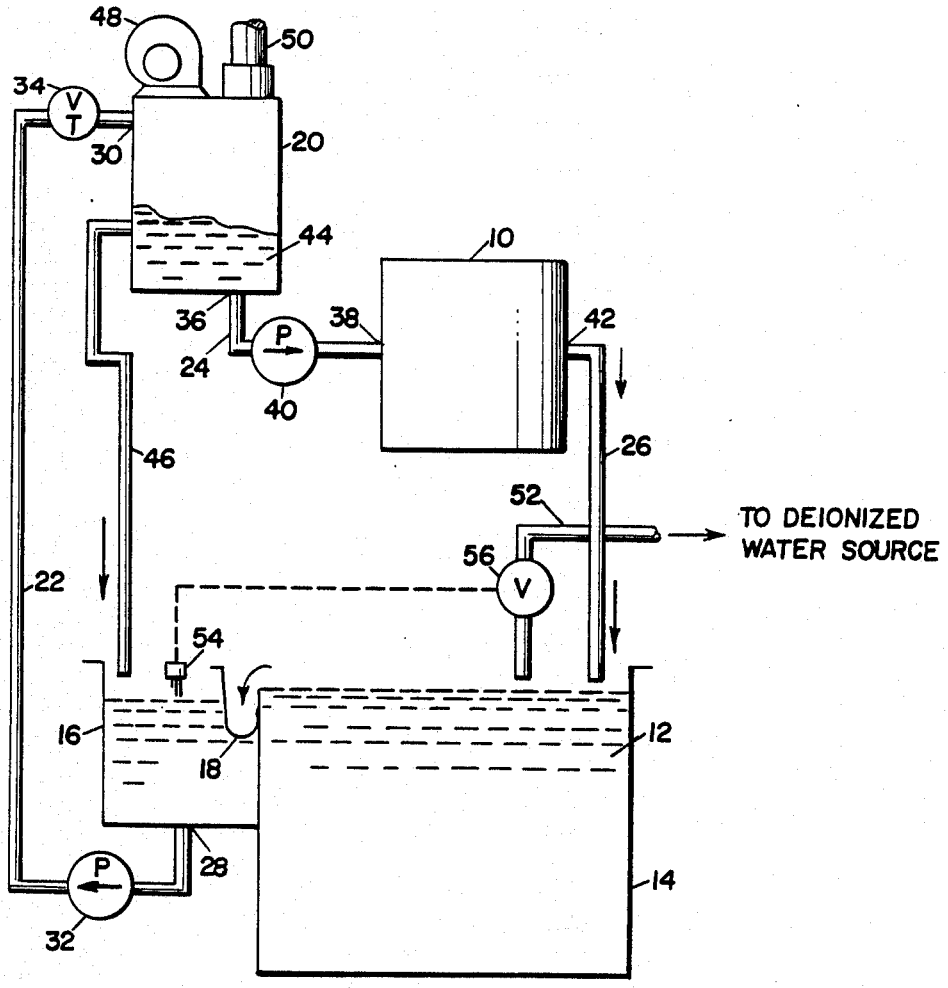
FIG. 1 is a schematic diagram illustrating a preferred embodiment of the invention.

In FIG. 1 there is illustrated an embodiment of the invention utilizing an electrosynthesis/electrodialysis purification system 10 for chemically maintaining an electroless copper plating solution 12 in a plating tank or bath 14, specifically for removing waste products from solution 12 and for replenishing it with hydroxyl ions. Associated with plating bath 14 is a sump 16 to which overflow from tank 14 is arranged to spill. Such overflow into sump 16 is filtered by one or more polypropylene bag filters 18. For convenience of illustration, one only such bag filter 18 is shown in the drawings.

A forced air, ambient temperature, atmospheric evaporator 20 is coupled to the system 10 and to the sump 16 by conduits 22, 24 and 26. Conduit 22 connects output 28 of sump 16 to input 30 of evaporator 20. A pump 32 is provided in conduit 22. Evaporator 20 thus may be located in a position that is elevated with respect to tank 14 and sump 16, a practical consideration in a metal plating area where floor space may be limited. A valve 34 may be connected in conduit 22, as shown, for controlling the flow of electroless copper solution to the evaporator 20. Conduit 24 connects a main output 36 of evaporator 20 to input 38 of the electrosynthesis/electrodialysis system 10. If desired, again for reasons of available floor space, the system 10 may be located at a distance from the evaporator 20 and tank 14. To that end a pump 40 may be provided in conduit 24. Output 42 of system 10 is connected by conduit 26 to tank 14.

Evaporator 20 evaporates water from the copper plating solution 12 to the atmosphere. In the evaporator 20, the solution 12 is sprayed on a plurality of evaporative finned surfaces (not shown). Runoff from the finned surfaces collects in a sump 44 at the bottom of the evaporator 20 and is arranged to be drained back to sump 16 by a conduit 46. Air is forced by a blower 48 over the finned surfaces to pick up moisture, which moisture may be carried out of the evaporator 20 through a duct 50 to the outdoors. Evaporator 20 depends for evaporation upon wetting the finned surfaces, forcing air over the finned surfaces, and also upon heat taken from the solution 12. Heating of the air upon contact with the solution 12, which is hot, being substantially higher than the ambient temperature and typically at a temperature of 120° F. or higher, increases the moisture holding capacity of the air.

In one embodiment of the invention, the evaporator 20 comprised a unit approximately 24 inches in diameter by 3 to 4 feet high and used a $\frac{1}{4}$ horsepower blower. It is estimated that this evaporator 20 provided 10 gallons/hour evaporation from a 120° F. electroless copper bath solution 12. This amount of evaporation lowered the temperature of the electroless copper bath solution 12 to 90°–95° F. at an 8 gallons per minute flow rate.

The large amount of air to which the electroless copper bath solution 12 is exposed in the evaporator 20, coupled with the cooling thereof, significantly improves the stability of the solution 12. This good stability is due to saturation of the solution 12 with oxygen. Additionally, the electroless copper bath solution 12 is purged of waste hydrogen. The resultant highly stable solution 12 can be introduced directly, with no extra cooling being needed, to the electrosynthesis/electrodialysis purification system 10 and to the overflow sump 16.

The evaporation rate of moisture from the solution 12 effected by the evaporator 20 is so high relatively to the replenishment rate that a deionized water line shown at 52 is needed to maintain the electroless copper bath solution volume. If desired, a level control device 54 in the sump 16 may be employed, as shown in FIG. 1, to control the supply of deionized water to the sump 16 by means of a solenoid valve 56 provided in the line 52.

Figure 2:
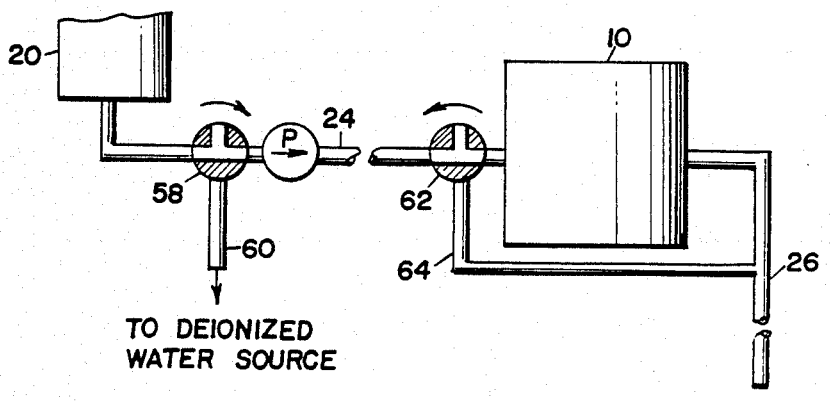
FIG. 2 illustrates a modification of the embodiment of FIG. 1 for facilitating cleaning of the transfer lines to the electrosynthesis/electrodialysis system.

The high evaporation rate of moisture from the solution 12 effected by the evaporator 20 is additionally beneficial in that, as shown in FIG. 2, the transfer lines or conduits 24 and 26 to the electrosynthesis/electrodialysis purification system 10 can be efficiently purged with deionized water. No overflow of the plating tank occurs during such purging due to the high evaporation rate of water from solution 12. No waste chelator is flushed to the drain system. Such cleaning or purging of the transfer lines to the system 10 is particularly beneficial when, for practical reasons of floor space limitation in a plating room, it is necessary to physically locate the system 10 at a distance from the plating tank 14 and the evaporator 20. Thus, as shown in FIG. 2, a three-way valve 58 may be provided in conduit 24 adjacent evaporator 20 with the valve 58 having a connection to a conduit 60 that is connected to a source of deionized water. Conduit 60 is normally disconnected from conduit 24, but may be connected thereto by rotation of a quarter turn clockwise. Such rotation disconnects the output 36 of evaporator from system 10 and couples the conduit 24 to the source of deionized water.

Adjacent system 10, a three-way valve 62, which may be identical to the valve 58, is connected in conduit 24. Valve 62 has a connection to one end of a conduit 64 that bypasses the system 10, the other end of conduit 64 being connected to conduit 26. Conduit 64 is normally disconnected from conduit 24 but is connected thereto by rotation of valve 62 a quarter turn counter-clockwise. Such rotation disconnects the input of system 10 from conduit 24.

With valve 58 rotated a quarter turn clockwise and valve 62 rotated a quarter turn counterclockwise, deionized water flows from conduit 60 through the conduits or lines 24 and 26 and purges the latter of materials that may have accumulated therein adhering to the walls, including chelator. Such purged materials are returned to the plating tank 14 through conduits 64 and 26.

Figure 3:
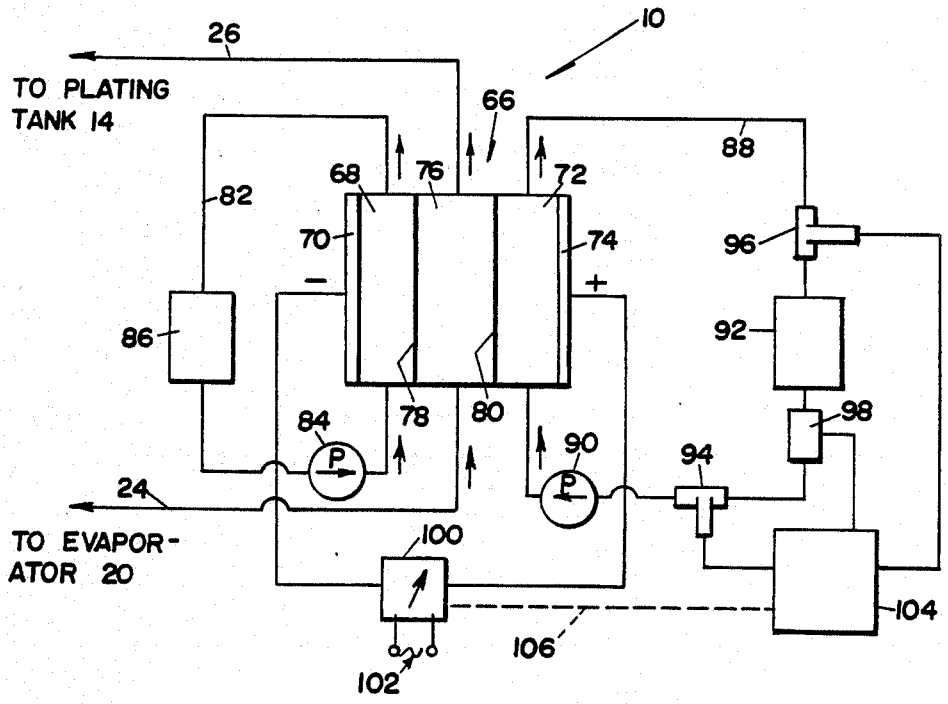
FIG. 3 is a schematic diagram illustrating in more detail the electrosynthesis/electrodialysis system of FIG. 1.

FIG. 3 provides a more detailed illustration of the electrosynthesis/electrodialysis purification system 10 of FIG. 1. System 10 is disclosed and is being claimed in my copending application for U.S. patent bearing Ser. No. 846,524, filed Mar. 31, 1986, the disclosure of which application, by reference, is incorporated herein.

As shown in FIG. 3, the system 10 employs a three-compartment electrodialytic cell indicated at 66. The function of cell 66 is to remove waste products from the solution 12 and to replenish the solution 12 with hydroxyl ions. While a single three-compartment cell 66 is shown in FIG. 3, it is preferred to employ, as disclosed in the aforementioned Korngold patent, a plurality of appropriately connected electrodialytic cells 66. In such a preferred embodiment, the connection of the cells 66 may be in series, in parallel or in series-parallel relationship as necessary or appropriate for achieving maximum efficiency.

Figure 4:
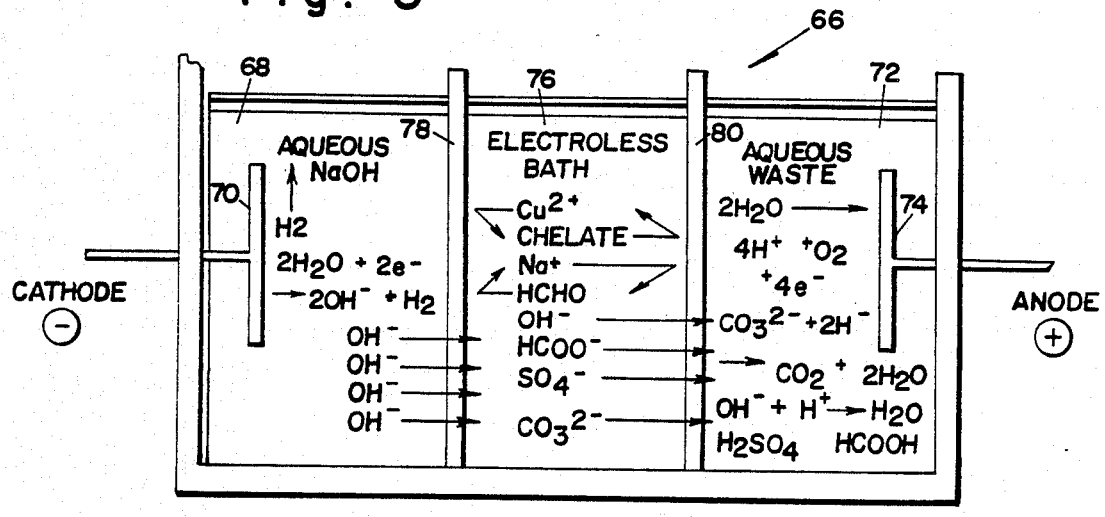
FIG. 4 is a schematic diagram of a three-compartment electrosynthesis/electrodialysis cell employed in the system of FIG. 3.

Each cell 66, as is shown in more detail in FIG. 4, includes three compartments that are sealed from the atmosphere. These compartments comprise a cathode compartment 68 containing a dimensionally stable planar cathode 70 that may be made of steel, an anode compartment 72 containing a dimensionally stable planar anode 74 that may be made of titanium plated with platinum, and an intermediate compartment 76 defined by anion exchange membranes 78 and 80. Membranes 78 and 80 separate the intermediate compartment 76 from the cathode compartment 68 and the anode compartment 72, respectively. The compartment 68 contains a catholyte solution comprising aqueous NaOH. The compartment 72 contains an anolyte solution comprising an aqueous waste acid that is produced during the electrosynthesis/electrodialysis process. The compartment 76 contains the electroless copper bath solution 12 that is to be chemically maintained.

With positive and negative direct current electrical potentials applied to the anode electrode 74 and to the cathode electrode 70, respectively, as shown in FIG. 4, the electrochemical half reaction occurring at the cathode electrode 70 is, as follows:

$$2\ H_2O + 2e^- \rightarrow 2\ OH^- + H_2\uparrow \quad (1)$$

The sodium hydroxide in the cathode compartment 68 is used simply for the purpose of maintaining alkalinity of the catholyte and of creating a concentration gradient of hydroxide across the associated permselective exchange membrane 78 to improve the efficiency of migration. Hydrogen gas is vented from the cathode compartment 68.

The electrochemical half reaction occurring at the anode electrode 74 is, as follows:

$$2\ H_2O \rightarrow 4H^+ + O_2 + 4e^- \quad (2)$$

The generated oxygen is vented from the anode compartment.

Combining the cathode and anode processes, the following electrochemical reaction is derived by doubling the reaction of equation (1) and adding it to the reaction of equation (2):

$$6\ H_2O \rightarrow 4\ OH^- + 4H^+ + 2\ H_2\uparrow + O_2\uparrow \quad (3)$$

Hydroxyl ions are produced or synthesized at the cathode electrode 70 and hydronium ions are produced or synthesized at the anode electrode 74.

As previously mentioned, the electroless copper bath solution to be chemically maintained is contained in the intermediate compartment 76 which separates the cathode electrode 70 from the anode electrode 74. Upon application of the direct electrical current potential between the cathode electrode 70 and the anode electrode 74, hydroxyl ions produced or synthesized at the cathode electrode 70 migrate across the permselective exchange membrane 78 associated with the cathode electrode 70 into the electroless copper plating bath solution 12 in compartment 76. Sulfate, formate and hydroxyl ions produced in the electroless copper plating bath solution 12 in compartment 76, in turn, migrate across the permselective exchange membrane 80 associated with the anode electrode 74 into the anolyte solution in the anolyte compartment 72. Hydronium ions are produced in the anolyte solution creating sulfuric acid from the accumulating sulfate and carbonic acid from the accumulating carbonate.

As a result of this process, the sulfate, formate and carbonate by-products that tend to build-up in the electroless copper plating bath are removed and replaced with fresh hydroxide. There is no build-up of cations such as sodium in the copper plating bath.

It is noted, also, that the showing in the drawings of the compartments 68, 76 and 72 of the electrodialytic cell 66 as having a relatively large dimension in the direction between the cathode 70 and the anode 74 is for purposes of illustration only. Thus, a preferred arrangement for each of the electrodialytic cells 66 is a relatively thin, closely packed structure with the ratio of the fluid volume within each of the compartments 68, 76 and 72 to the active surface area of one side of an associated permselective exchange membrane 78 or 80 being very low, for example, of the order of 1 to 5 or even lower.

A preferred structure for each of the electrodialytic cells 66 is disclosed and claimed in my copending application for U.S. patent bearing Ser. No. 822,076, filed Jan. 24, 1986, the disclosure of which application, by reference, is incorporated herein.

In system 10, as illustrated in FIG. 3, catholyte and, in particular, an aqueous solution of sodium hydroxide, is fed to the cathode compartment 68 and recirculated around a circuit 82 by a pump 84. While a source 86 of sodium hydroxide has been shown as included in circuit 82, such a source 86 may be dispensed with for some applications since the electrodialytic cell 66 manufactures its own sodium hydroxide. For such applications, it may be sufficient to provide an initial charge of aqueous sodium hydroxide in compartment 68 and circuit 82.

Anolyte, comprising an aqueous solution of sulfuric acid, is fed to the anode compartment 72 and recirculated around a circuit 88 by a pump 90. A source 92 of dilute sulfuric acid may be included in circuit 88 to maintain the acidity of the anolyte solution at a suitable level.

Figure 5:
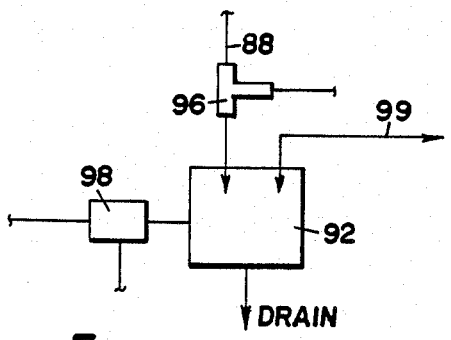
FIG. 5 illustrates a modification of the system of FIG. 3.

Preferably, as shown in FIG. 5, the source 92 may comprise piping tap water, or deionized water, directly to the anode compartment 72 through circuit 88. Since the conductivity of deionized water is too low to allow such a solution to be used as anolyte in unmodified form, a percentage, which may be substantial, of the anolyte output from the cell 66 may be diverted from the drain and recirculated with incoming deionized or tap water from a conduit 99.

The arrangement of FIG. 5 has the added advantages of allowing a reduction of the voltage in the cell and of providing increased waste transfer efficiency due to the lower acid content of the anolyte solution. An additional advantage is enhanced cell cooling resulting from the cooling capacity of the tap or deionized water.

As shown in FIG. 3, electroless copper plating bath solution 12 is fed through and recirculated around the circuit including conduits 24 and 26 to the intermediate compartment 76 of the electrodialytic cell 66 from the electroless copper plating bath 14 by pump 40 (which is shown in FIG. 1).

Pumps 84, 90 and 40 preferably are identical low pressure pumps having no metallic parts in contact with the electroless copper plating bath solution 12 being pumped. By this means, the pressures on the opposite sides of the permselective exchange membranes 78 and 80 are maintained substantially the same at all times, avoiding any tendency for the creation of differential pressures or forces that might stretch and distend and thereby tear or otherwise rupture the membranes. The use of pumps having no metallic parts in contact with the fluid being pumped avoids undesired plating out of copper that might otherwise occur due to stray electrical currents or autocatalysis of electroless copper on metals causing copper deposition and fouling.

Also, as shown in FIG. 3, two hydrogen ion or pH sensors 94 and 96 are suitably positioned in the anolyte stream or solution in the anolyte circuit 88. Sensor 94 is positioned in the circuit 88 to measure the hydrogen ion potential of the anolyte stream at the entrance to the anolyte compartment 72 of the electrodialysis cell 66. Sensor 96 is positioned in the circuit 88 to measure the hydrogen ion potential of the anolyte stream at the exit from the anolyte compartment 72. Such positioning of the pH sensors may be effected in a manner known to those skilled in the art. For example, the conduit or pipe forming the circuit 88 may be tapped and suitable fittings utilized to enable the sensing tips of each of the pH sensors 94 and 96 to be immersed in the anolyte stream.

The difference in pH measurement of the two sensors 94 and 96 provides a measure of the change in hydrogen ion content of the anolyte solution as the anolyte solution flows through the anolyte compartment 72, and, therefore, of the net $OH^-$ introduced into the electroless copper solution in the intermediate compartment 76. The pH sensors 94 and 96 each provide an output signal in the form of an electrical voltage that is indicative of the instantaneous hydrogen ion content of the anolyte solution at the region in which the tip of the sensor is immersed.

The pH of the influent anolyte stream to the anolyte compartment 72 is selected to be less than 2 and preferably less than 1.5. The pH of the effluent anolyte stream from the anolyte compartment may vary to a value down to 0.5 or lower depending upon the volume of the anolyte solution that is recirculated, the extent of waste concentration in the electroless copper plating solution bath, the electrical current density used, the flow rate of the anolyte stream, etc.

For measuring the flow of anolyte solution through circuit 88 of the electrodialysis apparatus 66, there is provided a flowmeter 98. The flowmeter 98 may be of a known orifice or other commercially available type suitable for measuring a quantity of anolyte solution passing a given section of the anolyte circuit 88 per unit of time, specifically, liters per minute, and includes appropriate means (not shown) for converting such measurement into a representative electrical signal.

The gross rate of hydroxide addition to the electroless copper solution in compartment 76 of the electrodialytic apparatus 66 is controlled by the adjustment of a direct electrical current control device 100 that is connected in circuit with and energized by an alternating electrical current source 102. Hydroxide synthesis follows Faraday's law. Hence, hydroxide synthesis is a direct function of the magnitude of the electrical current. Device 100 may comprise a suitable adjustable rectifier means as known in the art.

Responsive to the differential signal generated by sensors 94 and 96 and the signal generated by the flowmeter 98 is an electrical measuring and control device 104. Device 104, in a preferred embodiment, comprises a computer, specifically a commercially available CompuDAS computer, and provides a control force in response to the measurement of the anolyte solution pH content and the flow thereof for adjusting the adjustable rectifier device 100. The means for enabling such adjustment by computer 104 is indicated in FIG. 3 by the dotted line 106.

The hydrogen ion sensors 94, 96, flowmeter 98, rectifier 100 and computer 104 each per se form no part of the present invention and, hence, will not further be described herein.

The output terminals of rectifier device 100 are connected in circuit with the cathode electrode 70 and the anode electrode 74 of the electrodialytic apparatus 66. By this means, the electrical current to the apparatus 66 is adjusted in accordance with the difference in hydrogen ion content of the anolyte solution in circuit 88 entering and exiting the anolyte compartment 72 of apparatus 66 and, hence, as explained hereinbefore, in accordance with the net OH— rate of hydroxide addition to the electroless copper solution 12 in the intermediate compartment 76. As a result, the electrical current to the electrodialytic apparatus 66 is automatically adjusted as required to maintain the OH— production at the rate required by the operation of the electroless copper plating bath.

It is noted that the net rate of addition of hydroxyl ions to the electroless copper bath solution is a constantly changing complex equation. The anion exchange membrane 80 separating the waste anolyte solution from the electroless copper solution allows all anions to migrate therethrough. Thus, as shown in FIG. 4, OH—, $CO_3^{2-}$, $SO_4^{2-}$ and HCOO—0 all migrate into the anolyte compartment 72 and thus into the anolyte stream in circuit 88. Hydrogen ions are generated at near 100% efficiency in the anolyte solution in the same manner as are hydroxyl ions in the catholyte solution. The result is an infinite sink for hydroxyl and carbonate ions as they react instantly with $H^+$ in the anolyte. The concentration of $SO_4^{2-}$ and HCOO— in the anolyte solution is determined by the flow rate through the electrodialytic apparatus 66, the loading factor of the electroless copper plating bath 14 and thus the rate of waste generation in the electroless copper plating bath 14, and the magnitude of electrical current used. It is also a function of the specific concentrations of the OH— and $SO_4^{2-}$ used in the formulation of the electroless copper plating bath.

The proportion of anions transferring across the membrane 80 of the electrodialytic apparatus 66 from the intermediate compartment 76 is a function of their relative concentrations in the electroless copper plating solution 12. As the sulfate and formate ions are removed, a progressively greater proportion of hydroxl ions are also removed. The rate of removal of wastes decreases as their concentration in the electroless copper plating bath solution 12 decreases. Thus, the net OH— regeneration rate, as well as the net production efficiency of the electrodialytic apparatus 66 decreases also. In this way stable operation of the electroless copper plating bath solution 12 is controlled and maintained.

Another feature according to the present invention is concerned with dragout recovery, that is, recovery of all of the material that is rinsed from boards that have been copper plated in plating tank 14. By effecting such recovery, the loss of materials rinsed from the plated boards is eliminated as well as the cost of waste treatment and sludge disposal.

Figure 6:
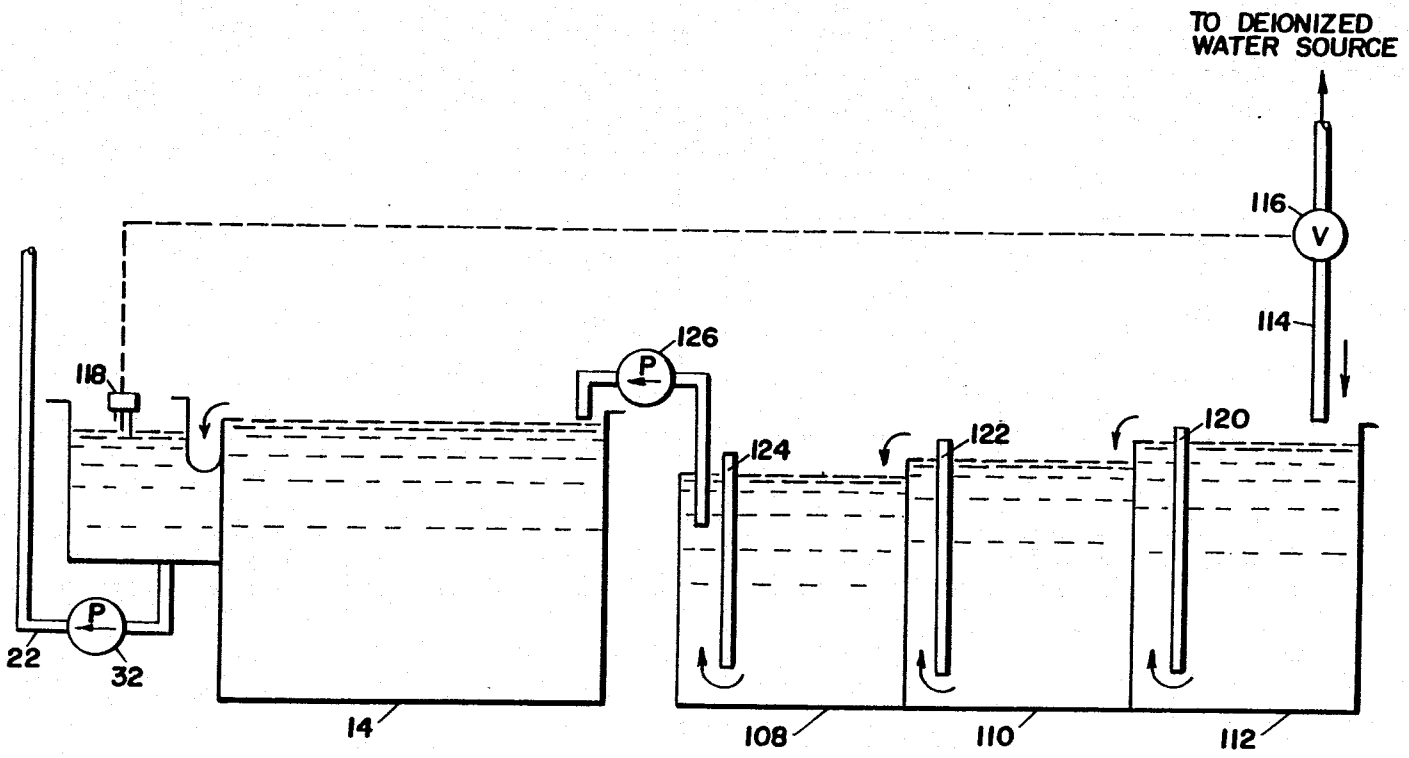
FIG. 6 illustrates a further modification of the embodiment of FIG. 1 for effecting dragout recovery.

For dragout recovery, as illustrated in FIG. 6, rinse water containing the dragout materials is counter flowed through three rinse tanks designated by reference numerals 108, 110 and 112, respectively, to the plating tank 14. In the operation of this embodiment of the invention, boards as plated and removed from plating tank 14 are rinsed in succession, first in tank 108, then tank 110 and finally tank 112. A supply of deionized water is provided to the most remote rinse tank 112 from a water line 114 in which there may be provided a solenoid valve 116 controlled by a level control device 118. Device 118 may be identical to the device 54 of FIG. 1. It is noted that such a level control arrangement is not required if the counter-current rinse volumes (in gallons per hour) are matched with the net evaporation rate of water from the electroless copper plating solution 12 (gross evaporation rate in gallons per hour minus the replenishment volume of liquid additions, consisting of stabilizer solution and copper/formaldehyde concentrate to replace consumed constituents).

Baffle means 120 in rinse tank 112 causes the water as supplied from the water line to circulate to the bottom of tank 112 with overflow solution spilling over into the adjacent rinse tank 110. Similar baffle means 122 and 124 in rinse tanks 110 and 108, respectively, cause the solutions in those tanks to circulate to the bottom with overflow solution from rinse tank 110 spilling over into rinse tank 108. Rinse tank 108, in turn, may be arranged to spill over into plating tank 14. If desired, as shown in FIG. 6, air lift or other suitable pump means 126 may be provided for transferring the solution from rinse tank 108 into the plating tank 14.

By counterflowing a single stream of water through three rinse tanks, as shown, the same water is used three times, thus multiplying the dilution effect with each rinse, and hence, the rinsing effectiveness of a given amount of rinse water. The excess water is removed from the plating tank 14 by the evaporator 20, heat for evaporation being derived from the hot plating bath solution 12. Most of the chelator and copper in the dragout may thus be recovered. Nothing has to be waste treated, thus eliminating waste treatment costs. Thus, in accordance with the invention there has been provided a method of and apparatus for eliminating bailout and the need for waste treatment in electroless copper purification by electrosynthesis/electrodialysis, and for avoiding destabilizing effects on the electroless copper plating solution during continued operation. It is noted with greater particularity, that the forced air evaporator 20 coupled to the electrosynthesis/electrodialysis purification system 10 solves a number of problems that have been encountered in the prior art electroless copper plating systems, as follows:

(1) Evaporation is independent of the geometry of the plating tank 14.

(2) Very high evaporation rates make bailout zero at all plating loadings and plating thicknesses.

(3) The high evaporation rates give sufficient cooling so that the electroless copper solution can be introduced directly to electrosynthesis/electrodialysis system 10, the need for water cooling having been eliminated.

(4) Dragout is completely eliminated. A triple flow counterflow deionized rinse provides sufficiently low flow rates that all or most of the rinse solution can be returned to the electroless copper plating bath 14 due to the high evaporation rates that are possible.

(5) The large amount of air that is blown through the electroless copper plating bath solution 12 promotes stability by lowering the bath temperature, saturating the bath solution 12 with oxygen, and stripping destabilizing hydrogen gas waste product from the bath solution 12.

With this description of the invention in detail, those skilled in the art will appreciate that modifications may be made to the invention without departing from its spirit. Thus, it is not intended that the scope of the invention be limited to the specific embodiments described. Rather, it is intended that the scope of the invention be determined by the appended claims and their equivalents.

What is claimed is:

1. In an electroless copper plating system for replenishing and maintaining the stability of an electroless copper plating solution in a plating bath, which solution tends to become depleted as the result of the reduction of water soluble cupric salt in an alkaline solution under copper plating and reducing conditions and which is replenished by an electrosynthesis/electrodialysis purification process, wherein in the continued operation of the plating bath, the rate of evaporation of water from the surface thereof is insufficient to preclude growth in the volume of electroless copper solution in the plating bath resulting from liquid additions thereto required to replace consumed constituents, thus giving rise to a need for bailout of the plating bath to prevent overflow thereof, and wherein increase in the amount of oxygen in the electroless copper solution and purging of waste hydrogen therefrom contribute to enhanced stability of the electroless copper solution, comprising a plating bath containing electroless copper plating solution, an electrosynthesis/electrodialysis purification system for chemically removing waste products from the electroless copper solution and for simultaneously replenishing the electroless copper solution with electrosynthesized hydroxyl ions, said purification system having an input and an output, a forced air, ambient temperature, atmospheric evaporator, and fluid conductor means for connecting said evaporator to said plating bath and to said purification system to cause the electroless copper solution to pass through said evaporator, said purification system being remotely located with respect to each of said plating bath and said evaporator, a source of deionized water, a first three-way valve connected to said fluid conducting transfer means between said purification system and said evaporator, said first three-way valve being located adjacent said evaporator and having a first adjusted position in which a flow of electroless copper solution is directed to flow from said evaporator through said fluid conducting transfer means to the input of said electrosynthesis-/electrodialysis purification system and having a second adjusted position in which deionized water from a source thereof is directed to flow through said fluid conducting transfer means for purging said fluid conducting transfer means, a second three-way valve connected to said fluid conducting transfer means between said purification system and said evaporator, said second three-way valve being located adjacent said electrosynthesis/electrodialysis purification system and having a first adjusted position in which a flow of electroless copper solution is directed to flow to the input of said purification system and through said electrosynthesis/electrodialysis purification system to the output thereof and to said plating bath and having a second adjusted position in which said input and said output of said electrosynthesis/electrodialysis purification system are directly connected whereby electroless copper solution conducted by said fluid conducting transfer means bypasses said purification system and flows directly to said plating bath, said atmospheric evaporator being operative to expose the electroless copper solution to an amount of air at atmospheric pressure sufficient to increase the rate of evaporation of water therefrom to at least a level where the amount of water evaporated from the electroless copper solution of the plating bath matches the liquid additions thereto required to replace consumed constituents, to saturate the electroless copper solution with oxygen, and to purge the electroless copper solution of waste hydrogen, whereby during the operation of the plating bath there is no tendency for the plating bath to overflow, thus eliminating the need for bailout, and whereby the electroless copper solution is saturated with oxygen and hydrogen waste is purged therefrom to enhance the stability thereof.

* * * * *